US008266768B2

(12) United States Patent
Sarra

(10) Patent No.: US 8,266,768 B2
(45) Date of Patent: Sep. 18, 2012

(54) APPARATUS FOR SECURING AN ORNAMENT TO A TEXTILE

(76) Inventor: Cathyann Sarra, Colts Neck, NJ (US)

( * ) Notice: Subject to any disclaimer, the term of this patent is extended or adjusted under 35 U.S.C. 154(b) by 316 days.

(21) Appl. No.: 12/692,257

(22) Filed: Jan. 22, 2010

(65) Prior Publication Data

US 2010/0186448 A1 Jul. 29, 2010

Related U.S. Application Data

(60) Provisional application No. 61/146,777, filed on Jan. 23, 2009.

(51) Int. Cl.
*A44C 1/00* (2006.01)

(52) U.S. Cl. ..... 24/3.1; 24/3.11; 24/457; 24/578.1; 24/578.17; 63/1.11; 63/1.17; 63/1.18; 63/33

(58) Field of Classification Search ..... 24/3.1, 24/3.11, 457, 578.17, 578.1, 580.1, 629, 24/630, 643, 68 J; 63/1.11, 1.16, 1.17, 1.18, 63/33

See application file for complete search history.

(56) References Cited

U.S. PATENT DOCUMENTS

| | | | | | |
|---|---|---|---|---|---|
| 468,677 | A | | 2/1892 | Maxheimer et al. | |
| 1,089,340 | A | | 3/1914 | Hemphill | |
| 1,225,710 | A | * | 5/1917 | Herschede | 24/326 |
| 1,519,380 | A | * | 12/1924 | Kochanski | 24/669 |
| 1,551,404 | A | | 8/1925 | Kennison | |
| 1,894,686 | A | * | 1/1933 | Heyman | 63/20 |
| 2,034,129 | A | * | 3/1936 | Boucher | 63/20 |
| 2,072,080 | A | * | 3/1937 | Boucher | 63/1.17 |
| 2,120,216 | A | * | 6/1938 | Handman | 63/20 |
| 2,198,558 | A | * | 4/1940 | Handman | 63/20 |
| 2,225,379 | A | * | 12/1940 | Pulver | 63/1.17 |
| 2,653,367 | A | * | 9/1953 | Orchoff | 24/707.4 |
| 3,848,311 | A | | 11/1974 | Fariello | |
| 4,035,630 | A | | 7/1977 | Burke | |
| 4,035,873 | A | * | 7/1977 | Epperson | 24/66.9 |
| 4,098,014 | A | | 7/1978 | Lauer et al. | |
| 4,566,157 | A | | 1/1986 | Packendorff | |
| 4,593,440 | A | * | 6/1986 | Tsamas | 24/265 WS |
| 4,631,929 | A | | 12/1986 | Hollingworth | |
| 4,879,882 | A | | 11/1989 | Johnson et al. | |
| 4,959,889 | A | | 10/1990 | Ciaravino | |
| 5,044,175 | A | * | 9/1991 | Razza | 63/1.17 |
| 5,048,311 | A | | 9/1991 | Mastrobuono | |
| 5,054,170 | A | * | 10/1991 | Otrusina | 24/580.11 |
| 5,097,679 | A | | 3/1992 | Johnson et al. | |
| 5,283,966 | A | * | 2/1994 | Rader et al. | 40/1.5 |
| 5,313,691 | A | | 5/1994 | Hashimoto | |
| 5,359,755 | A | | 11/1994 | Dalton et al. | |
| 5,435,047 | A | | 7/1995 | Colpo | |
| 5,682,648 | A | | 11/1997 | Miller | |
| 5,787,554 | A | * | 8/1998 | Hashimoto | 24/68 J |
| 6,026,658 | A | | 2/2000 | Weller | |
| 6,481,060 | B1 | * | 11/2002 | Tsai | 24/3.12 |

(Continued)

*Primary Examiner* — Robert J Sandy
*Assistant Examiner* — David Upchurch
(74) *Attorney, Agent, or Firm* — Alan Taboada; Moser Taboada

(57) ABSTRACT

Apparatus for connecting an ornament to the surface of a textile is provided herein. In some embodiments, an apparatus for connecting an ornament to the surface of a textile may include a bottom plate; a plurality of posts coupled to a surface of the bottom plate; and a top plate having at least one connection arm comprising a plurality of hooks moveably coupled thereto, wherein the at least one connection arm and the plurality of hooks are configured to interface with the plurality of posts to removably couple the top plate to the bottom plate.

12 Claims, 5 Drawing Sheets

U.S. PATENT DOCUMENTS

| | | | | |
|---|---|---|---|---|
| 6,481,069 | B1 | 11/2002 | Cheng | |
| 7,100,251 | B2 | 9/2006 | Howell | |
| 7,107,789 | B1 | 9/2006 | Bruner | |
| 7,225,638 | B2 * | 6/2007 | Loeff et al. | 63/12 |
| 2001/0034928 | A1 | 11/2001 | Skiles | |
| 2002/0108688 | A1 | 8/2002 | Reiss | |
| 2004/0200868 | A1 | 10/2004 | Woodman | |
| 2005/0208267 | A1 | 9/2005 | Mazzotta | |
| 2007/0044508 | A1 | 3/2007 | David | |
| 2007/0089456 | A1 | 4/2007 | Rose et al. | |
| 2007/0261209 | A1 | 11/2007 | Sanders et al. | |
| 2008/0110204 | A1 * | 5/2008 | Suen | 63/1.18 |
| 2008/0134552 | A1 | 6/2008 | Lough | |
| 2008/0273162 | A1 | 11/2008 | Porter | |

* cited by examiner

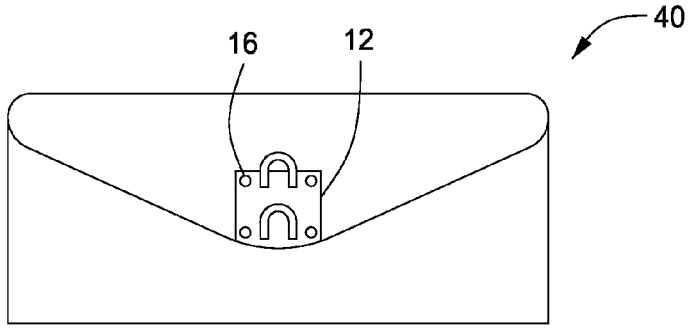
FIG. 14
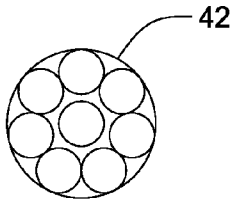
FIG. 15A
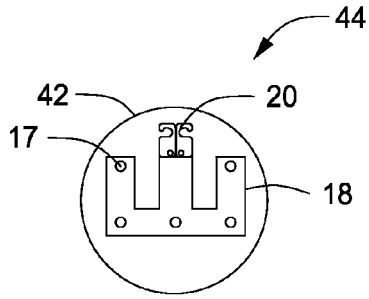
FIG. 15B
FIG. 16
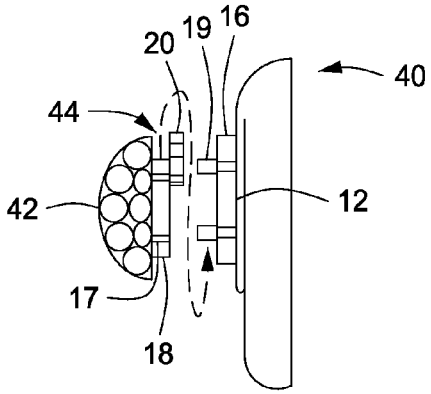
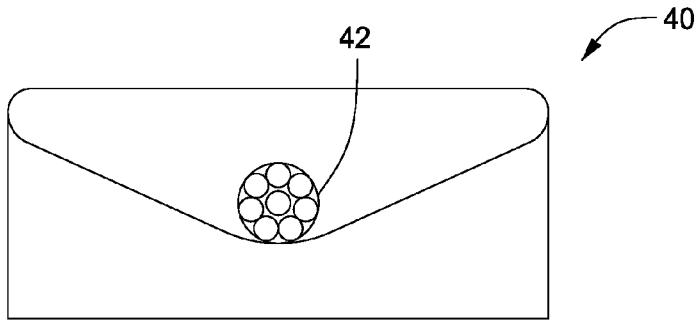
FIG. 17

APPARATUS FOR SECURING AN ORNAMENT TO A TEXTILE

CROSS-REFERENCE TO RELATED APPLICATIONS

This application claims benefit of U.S. provisional patent application Ser. No. 61/146,777, filed Jan. 23, 2009, which is herein incorporated by reference.

FIELD

Embodiments of the present invention generally relate to textiles, and more specifically, to an apparatus for securing an ornament to a textile.

BACKGROUND

Ornamenting textile products (e.g., apparel, pillow, curtains, etc.) is a common and cost efficient means to make a product more aesthetically pleasing. Various means are employed to secure ornaments or appliqués to a textile product. For example, an ornament or appliqué may be sewn or attached via an adhesive directly to the surface of a textile. However, the inventor has observed that such connections are often unsecure and typically result in the ornament or appliqué sagging, or partially separating, and eventually falling off, the textile.

Thus, the inventor has provided an improved apparatus for securing an ornament to a textile.

SUMMARY

Apparatus for connecting an ornament to the surface of a textile is provided herein. In some embodiments, an apparatus for connecting an ornament to the surface of a textile may include a bottom plate; a plurality of posts coupled to a surface of the bottom plate; and a top plate having at least one connection arm comprising a plurality of hooks moveably coupled thereto, wherein the at least one connection arm and the plurality of hooks are configured to interface with the plurality of posts to removably couple the top plate to the bottom plate.

In some embodiments, an apparatus for connecting an ornament to the surface of a textile may include a bottom plate coupled to a surface of a textile product on a first side of the bottom plate; a plurality of arches coupled to a second surface of the bottom plate opposite the first surface; a top plate having at least one connection arm comprising a plurality of hooks moveably coupled thereto, wherein the at least one connection arm and the plurality of hooks are configured to interface with the plurality of arches to removably secure the top plate to the bottom plate; and at least one decorative ornament coupled to a surface of the top plate.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

FIGS. 14-17 depict various views of an apparatus for securing an ornament to a textile in use in accordance with some embodiments of the present invention.

Figure 1:
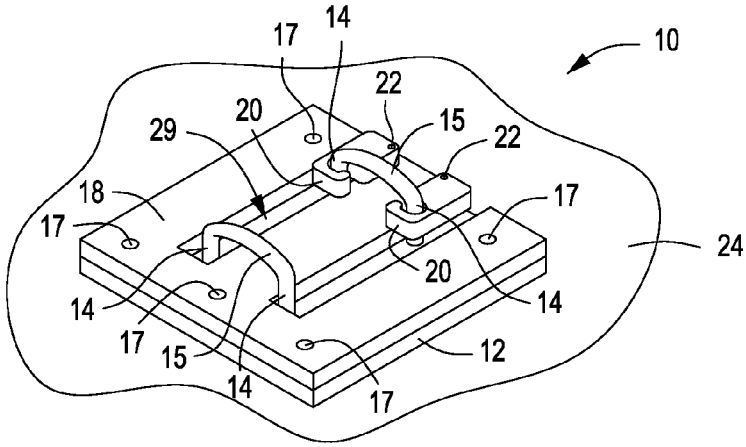
FIG. 1 is a perspective view of an apparatus for securing an ornament to a textile in accordance with some embodiments of the present invention.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of the present invention generally relate to textiles, and more specifically, to an apparatus for securing an ornament to a textile. The inventive apparatus may advantageously allow for a secure and removable connection between an ornament or appliqué and a textile product.

FIG. 1 is a perspective view of an apparatus for securing an ornament to a textile in accordance with some embodiments of the present invention.

The apparatus 10 generally comprises a bottom plate 12 having a plurality of posts 14 and a top plate 18 having at least one connection arm 29 comprising a plurality of hooks 20 configured to interface with the posts 14 of the bottom plate 12. The top plate 18 and bottom plate 12 may comprise any rigid material having sufficient strength to provide a secure coupling and resist breakage. For example, in some embodiments, the top plate 18 and bottom plate 12 may comprise a metal, such as gold, platinum, silver, stainless steel, aluminum, alloys or combinations thereof, or the like, or a plastic, such as polystyrene (PS), polyvinyl chloride (PVC), polyamide (PA), or the like, or a ceramic or ceramic composite.

In some embodiments, the top plate 18 comprises the same material as the bottom plate 12. Alternatively, in some embodiments, the top plate 18 comprises a different material than the bottom plate 12.

In some embodiments, the top plate 18, described more fully below with respect to FIGS. 6-10, may comprise a plurality of through holes 17 having suitable dimensions to interface with a fastener (not shown) for coupling the top plate 18 to a ornamental object (not shown). The ornamental object may be any object capable of being coupled to the top plate 18. For example, in some embodiments the ornamental object may comprise jewelry, such as decorative stones, for example diamonds, rhinestones, pearls, or the like, or a precious metal, for example, silver, gold, platinum, or the like. Alternatively, or in combination, in some embodiments, the ornamental object may comprise other materials, such as textiles, for example, a cloth or fabric, such as apparel, curtains, a pillow, or the like, or any other materials, such as plastics, metals, ceramics, or the like.

In some embodiments, the bottom plate 12 may be coupled to a surface 24 of a textile product, such as a pillow, apparel, clothing, curtain, or the like. For example, in embodiments where the bottom plate 12 is coupled to a pillow, the pillow may be a CAS CREATIONS POOFF PILLOW A CLUTCH CONNECTION™ pillow available commercially from CAS CREATIONS, located in Colts Neck, N.J.

Figure 2:
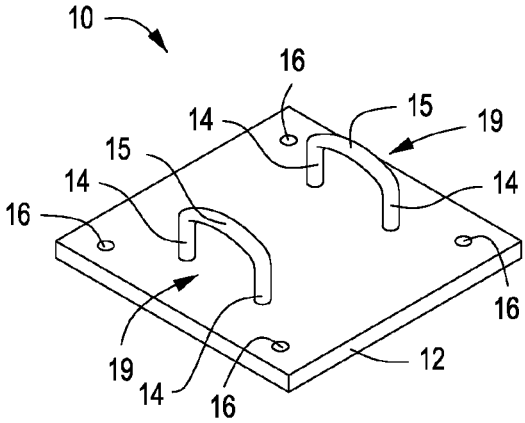
FIGS. 2-9 depict various views of an apparatus for securing an ornament to a textile in accordance with some embodiments of the present invention.
Figure 3:
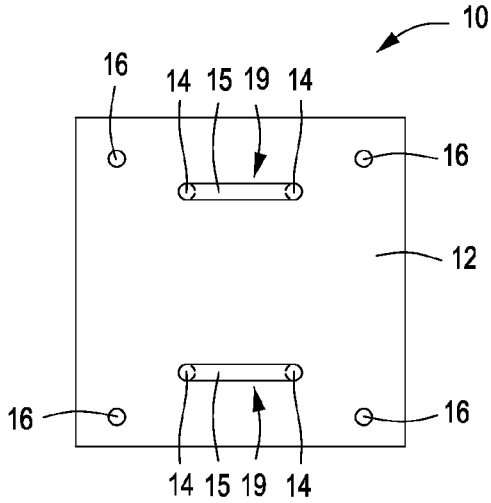
Figure 4:
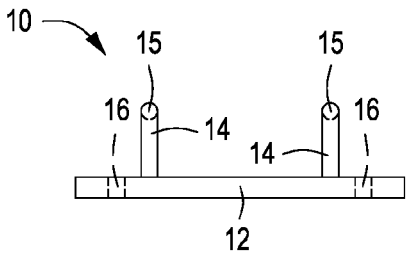
Figure 5:
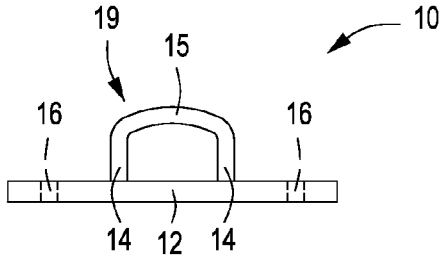

The bottom plate 12 may be coupled to the surface 24 of the textile product via any means suitable to provide a secure coupling, for example, via an adhesive. In some embodiments, such as depicted in FIG. 2, the bottom plate 12 may comprise a plurality of through holes 16 having suitable dimensions to interface with a fastener (not shown) for coupling the bottom plate 12 the surface 24 of the textile product. Although four through holes 16 are shown in FIG. 2, any amount of through holes may be utilized. For example, in some embodiments, the plurality of through holes 16 may comprise two, three, four, or more through holes 16. The fastener may be any fastener suitable to provide adequate coupling. For example, in some embodiments, the fastener may comprise a rivet, screw, toggle, pin or button. Alternatively, or in combination, in some embodiments, the bottom plate 12 may be coupled to the surface 24 via sewing a thread through the through holes 16.

The plurality of posts 14 may comprise any rigid material suitable to be coupled to the bottom plate 12 and resist deformation or breakage. In some embodiments, the plurality of posts 14 may comprise similar materials to those discussed above with respect to the bottom plate 12. The posts 14 may be coupled to the bottom plate 12 via any means suitable to provide a secure coupling. For example, in some embodiment, the posts 14 may be coupled to the bottom plate via a fastener, such as rivets, screws, bolts, or the like, or via an adhesive, or via solder. In some embodiments, the posts 14 and bottom plate 12 may be fabricated as one piece.

Although four posts 14 are shown, any number of posts may be coupled to the bottom plate 12. In some embodiments, such as depicted in FIG. 2, the plurality of posts 14 may coupled to one another in pairs via a cross member 15, thus forming an arch 19. In such embodiments, the arch 19 may comprise any dimensions suitable to accommodate coupling of the top plate (discussed above with respect to FIG. 1). For example, in each arch 19, the distance between the plurality of posts 14 may be about 0.5 inch, or in some embodiments, greater than about 0.5 inch, or in some embodiments less than about 0.5 inch such as 0.25 or 0.125 inch.

The bottom plate 12 may comprise any size and shape suitable for a desired application. For example, in some embodiments, the bottom plate 12 may be shaped as a square, rectangle, circle, triangle, polygon, abstract shapes, or the like.

Figure 6:
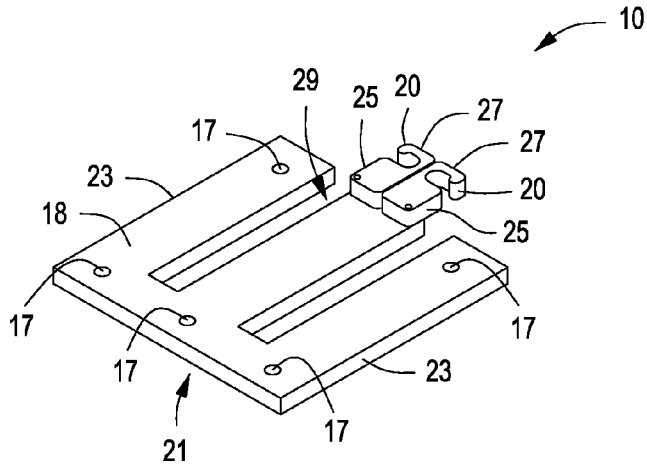

Referring to FIG. 6, in some embodiments, the top plate 18 generally comprises at least one connection arm (one shown) 29 coupled to a body 21, wherein the at least one connection arm 29 comprises a plurality of hooks 20 movably coupled thereto. The top plate 18 may comprise any rigid material, for example, the top plate 18 may comprise a metal, such as gold, platinum, silver, stainless steel, aluminum, alloys or combinations thereof, or the like, or a plastic, such as polystyrene (PS), polyvinyl chloride (PVC), polyamide (PA), or the like, or a ceramic or ceramic composite.

In some embodiments, the top plate 18 may comprise a plurality (two shown) of arms 23 coupled to the body 21 and disposed adjacent to the at least one connection arm 29. The plurality of arms 23 may comprise any suitable size and shape suitable for intended use of the apparatus 10. For example, in some embodiments, each of the plurality of arms 23 may be rectangular in shape, such as depicted in FIG. 6. In some embodiments, for example where the plurality of arms 23 are rectangular in shape, the plurality of arms 23 may comprise a width of about 0.125 inch and a length of about 0.25.

In some embodiments, the at least one connection arm 29, body 21, and plurality of arms 23 may be fabricated separately and coupled to one another via any means suitable to provide adequate coupling, for example, via welding, soldering, adhesives, or the like. In some embodiments, the at least one connection arm 29, body 21, and plurality of arms 23 may comprise the same material, or in some embodiments, may comprise a different material. Alternatively, the connection arm 29, body 21 and plurality of arms 23 may be fabricated from a single piece of material, thus forming the top plate 18 as an integral structure.

Figure 6A:
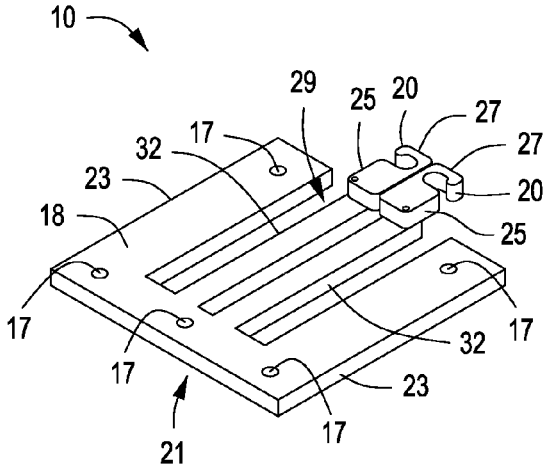
Figure 7:
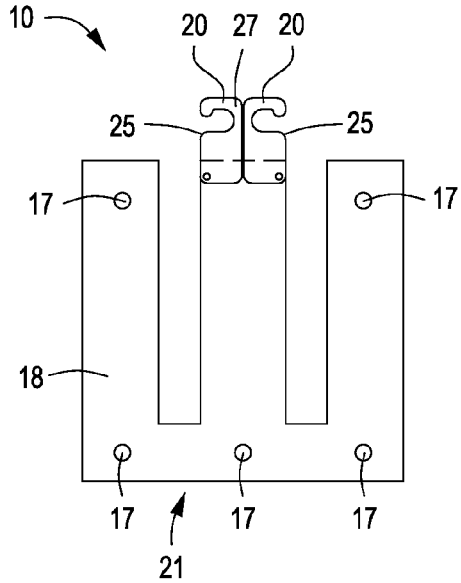
Figure 8:
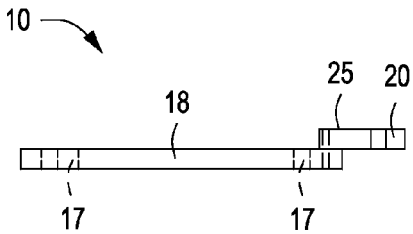
Figure 9:
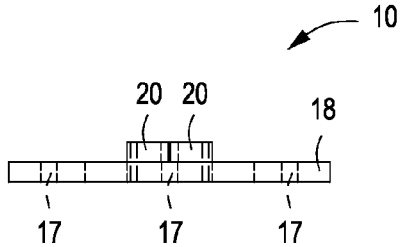

The at least one connection arm 29 may comprise any number of arms having any suitable shape and size sufficient to support the plurality of hooks 20 and allow for rotational movement of the plurality of hooks 20. Although one connection arm 29 is shown in FIG. 6, two or more connection arms may be utilized. For example, in some embodiments and as depicted in FIG. 6A, the at least one connection arm 29 may comprise two connection arms 32 disposed adjacent to one other and having a space 19 in between. Each of the two connection arms 32 may include a respective one of the plurality of hooks 20 movably coupled thereto.

In some embodiments, each of the plurality of hooks 20 may comprise a body 25 for coupling the respective hook of the plurality of hooks 20 to the at least one connection arm 29 and a hooked end 27 having dimensions sufficient to interface with the dimensions of the posts 14 (described above with respect to FIGS. 1-5). For example, in some embodiments, the hooked end 27 may comprise an inner diameter of about 0.25 inch, or in some embodiments greater, or less than about 0.25 inch. The plurality of hooks 20 may comprise any rigid material suitable for the specific application for which the apparatus may be used. For example, the plurality of hooks 20 may comprise similar materials discussed above with respect to the top plate 18.

Figure 10:
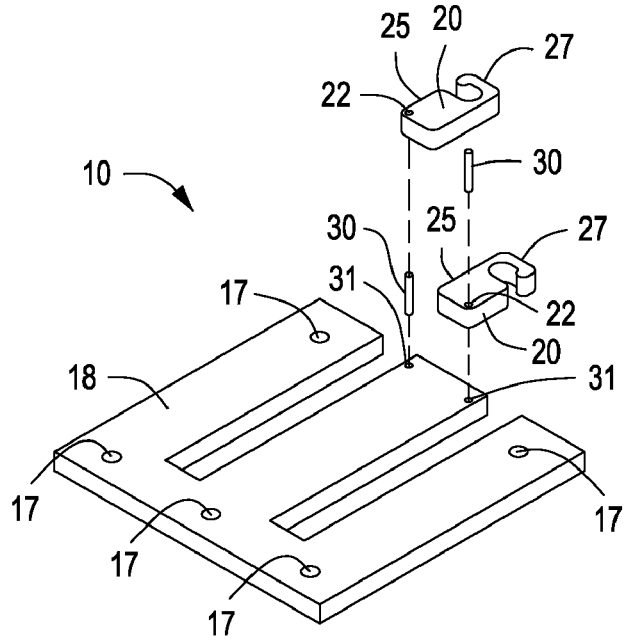
FIG. 10 is an exploded view of a portion of an apparatus for securing an ornament to a textile in accordance with some embodiments of the present invention.

The plurality of hooks 20 may be coupled to the at least one connection arm 29 via any means suitable to allow rotation of the plurality of hooks 20. For example, in some embodiments, the plurality of hooks 20 may be coupled to the at least one connection arm 29 via a plurality of pins 30, such as depicted in FIG. 10. In such embodiments, each of the plurality of hooks 20 comprise a through hole 22 having dimensions suitable to interface with the pins 30. The pin 30 may then be secured in a respective hole 31 of the at least one connection arm 29. The pins 30 may be secured in each of the respective holes 22, 31, for example, by a friction fit (e.g., press fit). In some embodiments, the pins 30 may be press fit in the holes 31 and may have a top end that is peened over after the hooks 20 are placed on the pins 30. Alternatively or in combination, the each pin 30 may be a post of a rivet, and the head of the rivet may be secured after the hooks 20 are placed on the pins 30.

Figure 11:
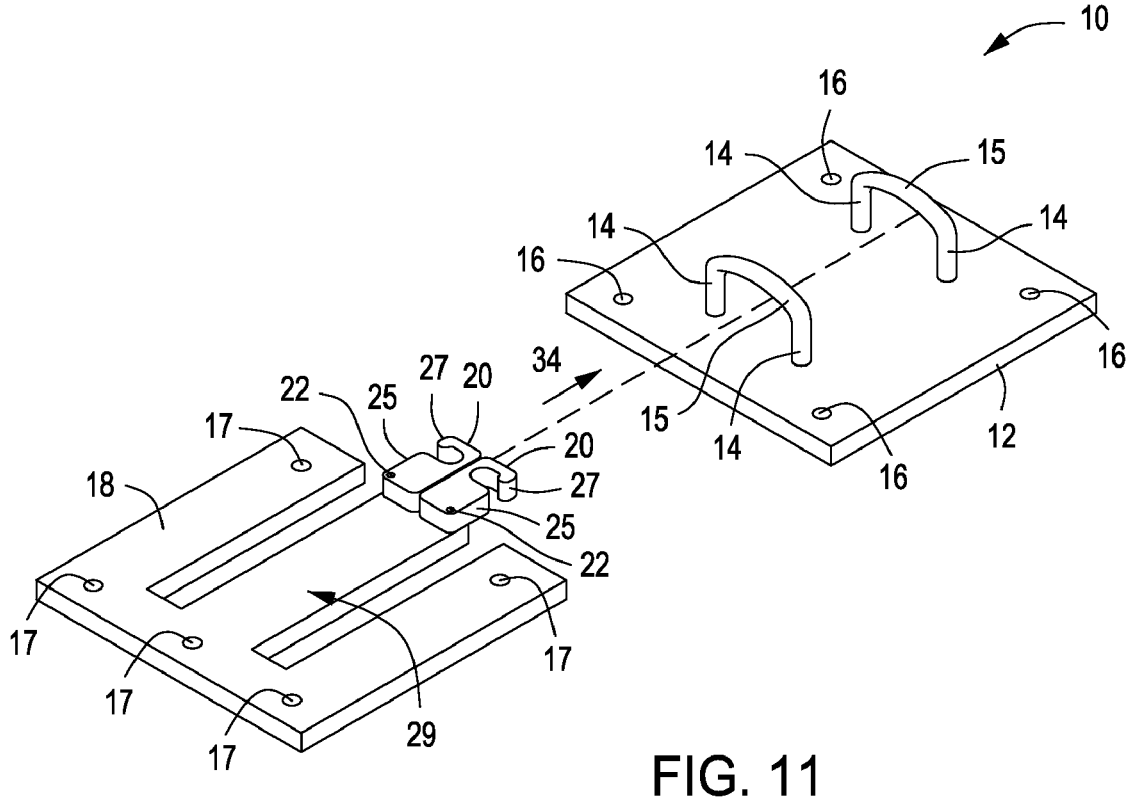
FIGS. 11-13 depict various views of the operation of an apparatus for securing an ornament to a textile in accordance with some embodiments of the present invention.
Figure 12:
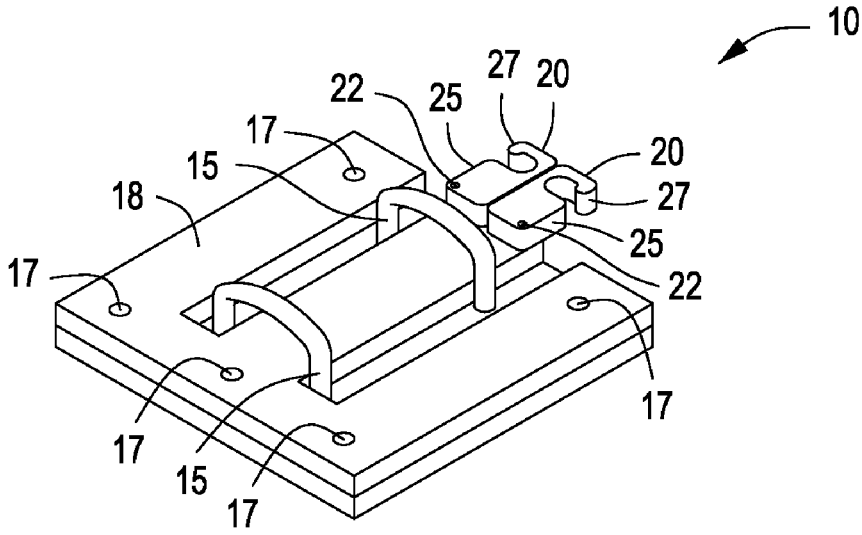
Figure 13:
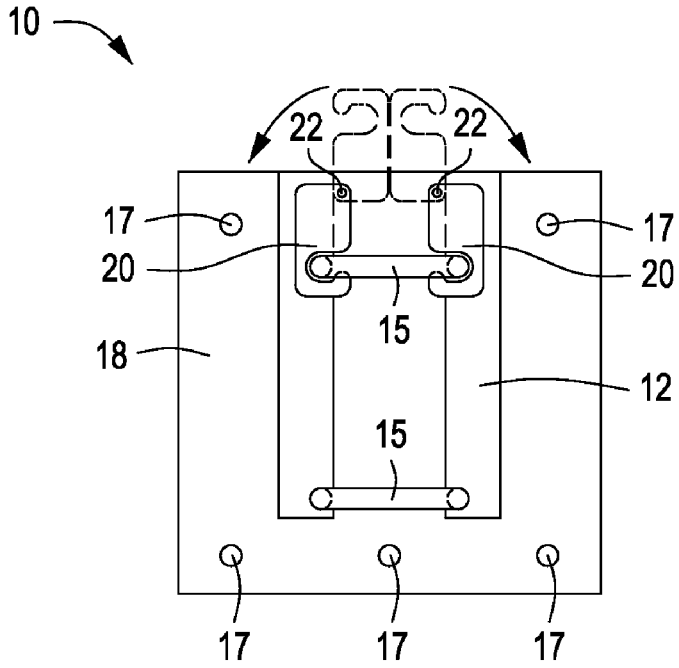

In operation, for example, the top plate 18, having the plurality of hooks 20 rotated in an outward direction 34, is positioned atop the bottom plate 12, wherein the at least one connection arm 29 is inserted between posts 14, as depicted in FIGS. 11 and 12. Although the top plate is shown in one particular orientation in FIGS. 11 and 12, the top plate may be positioned in any orientation suitable for its intended use. For example, in some embodiments, the top plate 18 is positioned atop the bottom plate 12 wherein the plurality of hooks 20 face away from the bottom plate 12, such as depicted in FIGS. 11 and 12. Alternatively, in some embodiments, the top plate 18 may be positioned atop the bottom plate 12 such that the plurality of hooks 20 are disposed between the top plate 18 and bottom plate 12, for example, such as depicted in FIGS. 14-16, described below. Following the positioning of the top plate 18 atop the bottom plate 12, the plurality of hooks 20 may be rotated such that the hooked end 27 of each of the plurality of hooks 20 interfaces the posts, thereby securing the top plate 18 to the bottom plate 12 in a static position.

In use, for example, the bottom plate 12 may be secured to some form of apparel or accessory, for example, a pocketbook or handbag 40, as illustratively depicted in FIG. 14. The bottom plate 12 may be coupled to the handbag 40 via any means suitable to provide a secure coupling. For example, the bottom plate 12 could be coupled to the handbag 40 via an adhesive. Alternatively, or in combination, the bottom plate 12 may be coupled to the handbag 40 using the through holes 16, as described above with respect to FIG. 1.

An ornamental object 42, for example, a broach, may be coupled to the top plate 18, as depicted in FIGS. 15A-B. The top plate 18 may be coupled to the back side 44 of the ornamental object 42, via any means suitable to provide a secure coupling. For example, the top plate 18 could be coupled to the ornamental object 42 via an adhesive. Alternatively, or in combination, the top plate 18 may be coupled to the ornamental object 42 using the through holes 17, as described above with respect to FIGS. 6-10.

Referring to FIG. 16, the top plate 18, having the accessory 42 coupled thereto may be coupled to the bottom plate 12 as described above with respect to FIGS. 11 and 12. Once coupled, the top plate 18 and bottom plate 12 remain at least partially, or in some embodiments, fully, hidden behind the ornamental object 42, as depicted in FIG. 17.

Although the above description may be directed towards coupling ornaments to textiles, it is contemplated that the apparatus 10 may be adapted for other uses. For example, in some embodiments, including any of the above embodiments, the apparatus 10 may be adapted as a means to secure curtains to a curtain rod. In some embodiments, the apparatus may be used to secure accessories to apparel, for example, securing a belt buckle to a belt, an ornament to a hat, jacket, sweater, or other article of clothing, and the like.

While the foregoing is directed to embodiments of the present invention, other and further embodiments of the invention may be devised without departing from the basic scope thereof.

The invention claimed is:

1. An apparatus for connecting an ornament to the surface of a textile, comprising:

a bottom plate;

a plurality of posts coupled to a surface of the bottom plate, wherein the plurality of posts comprise a first post, second post and a cross member coupling the first post to the second post; and a top plate having at least one connection arm comprising a plurality of hooks moveably coupled thereto, wherein the at least one connection arm and the plurality of hooks are configured to interface with the plurality of posts to removably couple the top plate to the bottom plate.

2. The apparatus of claim 1, wherein the top plate further comprises at least one ornamental object.

3. The apparatus of claim 2, wherein the at least one ornamental object comprises at least one of an appliqué, decorative stones, jewelry, precious metals, textiles, plastics or ceramics.

4. The apparatus of claim 2, wherein the top plate further comprises a plurality of through holes, wherein each of the plurality of through holes is configured to interface with a fastener to facilitate coupling of the top plate to the at least one ornamental object.

5. The apparatus of claim 1, wherein the top plate is constructed from at least one of gold, platinum, silver, stainless steel, aluminum, alloys or combinations thereof, polystyrene (PS), polyvinyl chloride (PVC), polyamide (PA), ceramic, or ceramic composite.

6. The apparatus of claim 1, wherein the top plate further comprises:

a body;

a first arm coupled to the body; and a second arm coupled to the body, wherein the first arm and second arm are disposed adjacent to the at least one connection arm.

7. The apparatus of claim 1, wherein the bottom plate is coupled to a surface of a textile product.

8. The apparatus of claim 7, wherein the textile product is one of a pillow, an apparel, or a curtain.

9. The apparatus of claim 7, wherein the bottom plate further comprises a plurality of through holes, wherein each of the plurality of through holes is configured to interface with a fastener to facilitate coupling of the bottom plate to the surface of the textile product.

10. The apparatus of claim 1, wherein the bottom plate is constructed from at least one of gold, platinum, silver, stainless steel, aluminum, alloys or combinations thereof, polystyrene (PS), polyvinyl chloride (PVC), polyamide (PA), ceramic or ceramic composite.

11. The apparatus of claim 1, wherein each of the plurality of hooks comprise:

a body having at least one through hole;

a hooked end coupled to the body to interface with the plurality of posts; and a pin moveably coupled to the body, wherein the pin is disposed within the through hole, and wherein the pin is coupled to the at least one connection arm.

12. The apparatus of claim 1, wherein the at least one connection arm comprises two adjacent parallel arms, and wherein each of the two adjacent parallel arms has one hook of the plurality of hooks movably coupled thereto.

* * * * *